United States Patent [19]

Lafever

[11] Patent Number: 4,873,774

[45] Date of Patent: Oct. 17, 1989

[54] SHOE SOLE WITH RETRACTABLE CLEATS

[75] Inventor: Alan W. Lafever, Cookeville, Tenn.

[73] Assignee: Universal Plastics Incorporated, Cookeville, Tenn. ; a part interest

[21] Appl. No.: 162,588

[22] Filed: Mar. 1, 1988

[51] Int. Cl.[4] ..... A43C 15/14; A43B 13/24

[52] U.S. Cl. ..... 36/61; 36/29; 36/134

[58] Field of Search ..... 36/61, 134, 29, 3 R, 36/3 A, 7.6, 7.7

[56] References Cited

U.S. PATENT DOCUMENTS

| | | | |
|---|---|---|---|
| 2,303,744 | 12/1942 | Jacobs | 36/29 |
| 3,793,751 | 2/1974 | Gordos | 36/61 |
| 3,925,529 | 12/1975 | Bernier et al. | 36/134 X |
| 4,375,729 | 3/1983 | Buchanen, III | 36/61 |
| 4,674,200 | 6/1987 | Sing | 36/29 X |

FOREIGN PATENT DOCUMENTS

| | | | |
|---|---|---|---|
| 9776 | 5/1880 | Fed. Rep. of Germany | 36/61 |
| 1965198 | 8/1971 | Fed. Rep. of Germany | 36/61 |
| 2262528 | 6/1974 | Fed. Rep. of Germany | 36/61 |
| 1220618 | 3/1986 | U.S.S.R. | 36/28 |
| 22043 | 1/1906 | United Kingdom | 36/3 R |

*Primary Examiner*—James Kee Chi

*Attorney, Agent, or Firm*—Fleit, Jacobson, Cohn, Price, Holman & Stern

[57] ABSTRACT

A show sole is provided with one or more chambers therein. A piston-like cleat plate is fitted for vertical movement in each chamber. Cleats are fitted to the cleat plates, and openings are provided in the chamber bottom for permitting the cleats to pass therethrough when extended. The cleat plates are spring-biased to a retracted position. A source of fluid pressure such as a squeeze bulb type air pump is connected for supplying fluid pressure to the chambers to cause the cleat plates to move downwardly to extend the cleats from the sole bottom, to provide gripping traction. An inflatable member can be provided above the cleat plate in each chamber. A pair of soles may be connected via supply lines to a remote pump positionable at a convenient location on the wearer's person.

9 Claims, 2 Drawing Sheets

SHOE SOLE WITH RETRACTABLE CLEATS

BACKGROUND AND SUMMARY OF THE INVENTION

The present invention relates generally to footwear, and more particularly to a shoe sole which is provided with retractable cleats.

There are known various types of traction-improving devices having spikes or cleats which may be attached to shoes and boots for giving the wearer surer footing. There are also known devices in which provision is made in a shoe or boot sole for mounting a set of spikes or pins which are linked mechanically to a mechanism by operation of which the spikes can be made to protrude outwardly from the sole bottom or to be retracted into the sole proper. Examples of known retractable spike arrangements as applied to shoe soles can be found from U.S. Pat. Nos. 3,793,751 and 4,375,729. In the former, a cam mechanism is utilized, with a pair of long cams being operated to depress spike plates so that the spikes project downwardly from the sole bottom. A manual knob at the rear of the heel operates a heel cam directly and a sole cam via a flexible coupling shaft. Such an arrangement is useful for a golf shoe where manual operation of the cam mechanism need be performed only upon commencing and finishing a round of golf, that is, upon entering on and leaving from the golf course; however, such an arrangement does not lend itself to frequent use in winter ice and snow because of the need to operate the manual control knob at the heel, which presents problems of access and operation upon encountering, for example, snow or slush of several inches' depth.

The latter arrangement also utilizes a cam member for urging spikes from a retracted to an extending position. A cam actuating mechanism in the form of a sliding member can be operated by finger pressure applied against a thin-walled heel portion of the shoe. However, while such an arrangement avoids the access problems inherent with protuding manual knobs, it still requires the wearer to operate the mechanism directly at the heel, which is difficult and requires stooping, bending down or sitting to reach both heels every time it is desired to extend or retract the spikes.

Such prior arrangements thus present disadvantages in use for persons who must frequently walk across patches of slippery ice or snow and who also must frequently enter and exit buildings, for example delivery persons and letter carriers and whose hands are frequently laden with goods or mail. For example, when a delivery person wearing the conventional type retractable spike shoes is making a delivery to a building, home or office during icy winter weather conditions, it might be necessary for the delivery person to first manually operate the mechanism in each shoe to extend the spikes before alighting from the delivery vehicle, then make their way across icy ground to the building entrance, whereupon, before entering, it would then be necessary to once more manually operate the mechanism in each shoe to retract the spikes to avoid damage to the floor covering in the building, and then, after making the delivery or pickup to once more extend the spikes upon exiting, make their way to the vehicle, retract the spikes, and so on.

It is desirable therefore to improve on the known retractable spike type footwear in order to eliminate the requirement of reaching down to each shoe every time the spikes are to be extended or retracted, which is an encumbrance to the utility of such footwear.

It is therefore an object of the present invention to overcome the above-noted disadvantages by providing a shoe sole with retractable cleats which does not require the wearer to manually operate the individual extending/retracting mechanism at each shoe.

It is another object of the present invention to provide a shoe sole with retractable cleats which does not depend upon mechanical linkages for extending and retracting the cleats.

It is further an object of the present invention to provide a shoe sole with retractable cleats which includes a remotely-operated actuating means which permits the wearer to conveniently actuate extension/retraction of the cleats of both shoe soles simultaneously by remote control using only one hand and without stooping down.

These and other advantages and objects are realized in the present invention by providing a shoe sole which includes pneumatic or hydraulic chambers provided therein. Each chamber is provided with a cleat plate which is vertically displaceable under the influence of pneumatic or hydraulic pressure, the cleat plates thus acting as pistons within the chambers. Springs provided between the bottom of each chamber and the cleat plates urge the cleat plates upwardly to a normal retracted position in which the cleats do not protrude from the sole bottom. Pressure tubing connects the chambers to a remotely located pump by which pneumatic or hydraulic pressure can be supplied to the space above the cleat plate in each chamber to force the cleat plate downwardly against the springs to an extended position with the cleats protruding from the sole bottom, and to maintain pressure in the chambers to keep the cleats extended.

The pump in a preferred embodiment of the invention is a remotely connected squeeze bulb type air pump provided with a valve whereby, before pumping air into the chambers to extend the cleat plates against the force of the springs, the valve is closed to communicate pneumatic pressure to the chambers, and then the pump is operated to extend the cleats, and the pressure in the chambers keep the cleats extended. Opening the valve bleeds off the air from the chambers, causing the cleats to retract under the urging of the springs. In this way, the operation of extending the cleats merely requires a simple manual operation of the valve and squeezing of the pump bulb, and retraction of the cleats is performed by simply opening the valve.

Advantageously, plural chambers can be provided in each of a pair of shoe soles according to the present invention, and the separate chambers can be connected to a mutual pressure supply line. As a further advantage, it is possible in accordance with the present invention, to utilize a single pressure source for simultaneously actuating the cleats in both soles of a pair of shoes so equipped by connecting pressure lines from the chambers in each sole to a single pump. By the use of pressure lines for intercommunication between the pressure source and chambers in both soles, it is thereby made possible to locate the pressure source remotely at a desired distance from the shoe soles and at a convenient location on the wearer's person, for example, at the waist, so as to be within easy reach.

It is possible to retract cleats by a vacum system type (air or hydraulic) pump, which would eliminate the use of springs.

BRIEF DESCRIPTION OF THE DRAWINGS

The objects and advantages of the present invention will be more fully appreciated from the following detailed description taken together with the drawings, in which.

DETAILED DESCRIPTION OF THE INVENTION

Figure 1:
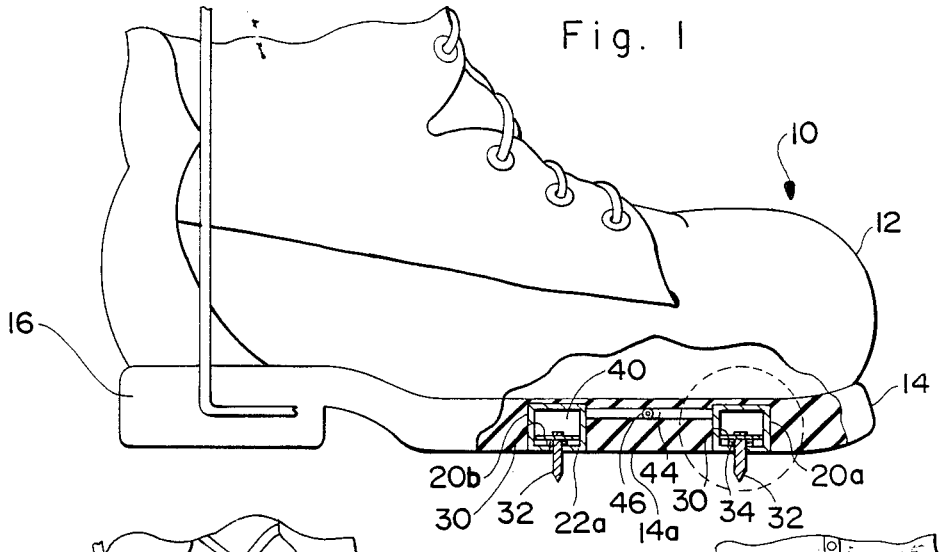
FIG. 1 is a side partial sectional view showing a shoe sole with retractable cleats according to the present invention applied in use in footwear.

Referring now to the drawings, in which like elements among the different figures are designated by like reference numerals, there is shown in FIGS. 1 through 5 a shoe sole with retractable cleats in accordance with the present invention as applied in use in a work or utility shoe 10.

In this regard, it will be appreciated that the present invention is amenable to use in various embodiments, for example, incorporated as a sole component in various types of footwear, or, for example, as a separate sole component which may be attached by straps or other suitable fastening means to conventional footwear, to permit the benefits of the present invention to be enjoyed with all types of footwear. It is intended therefore that the description hereinbelow be taken as illustrative only and not be construed as limiting the invention to the particular embodiments shown and described.

Shoe 10 includes an upper portion 12 for enclosing the foot, as well as a sole portion 14 for supporting the foot above the ground. Sole 14 may include a heel lift portion 16.

Contained within sole 14 are a plurality of chambers 20, for example a front chamber 20*a* proximate the toe portion of sole 14 and a rear chamber 20*b* situated at a distance behind front chamber 20*a*. Chambers 20*a* and 20*b* are of identical construction, and operate in the manner of pneumatic or hydraulic cylinders. Chambers 20*a*, 20*b* are of hollow rectangular form and are closed on all six sides. Chambers 20*a*, 20*b* may be formed of a length of square or rectangular tubing 22, for example, of aluminum, steel or other rigid lightweight material, and end caps 24 of rubber or plastic are provided for sealingly closing the open ends of tubing 22.

The flat bottom walls 22*a* of chamber 20*a*, 20*b* may be set flush with the bottom tread surface 14*a* of sole 14, or may be set slightly above the sole bottom 14*a*. Bottom walls 22*a* are provided with spaced holes 22*b* centrally located therethrough, and in the case that bottom walls 22*a* are set above sole bottom 14*a*, then sole bottom tread surface 14*a* will also be provided with holes therethrough in correspondence with holes 22*b*.

As mentioned above, chambers 20*a*, 20*b* operate as pneumatic or hydraulic cylinders. To this end, a flat rectangular plate 30 is fitted in each chamber 20*a*, 20*b* for vertical movement therewithin, the plate 30 acting in the manner of a piston. Plates 30 may be formed of aluminum, steel or other rigid material and fit sealingly within chambers 20*a*, 20*b*.

Round spike-like cleats 32 are fixed in plate 30 and extend downwardly from the underside thereof. The cleats 23 are formed with pointed ends 32*a* for gripping in ice. The cleats 32 are of metal and preferably hardened at least at pointed ends 32*a* for wear resistance.

The cleats 32 are fixed in each plate 30 at spaced locations centrally therealong aligned with the holes 22*b* in chamber bottom wall 22*a*, so that the cleats 32 can project out through the holes 22*b*. The cleats 32 may be threaded at their upper ends 32*b* and threadedly fixed in threaded holes 30*a* provided in plate 30.

Figure 2:
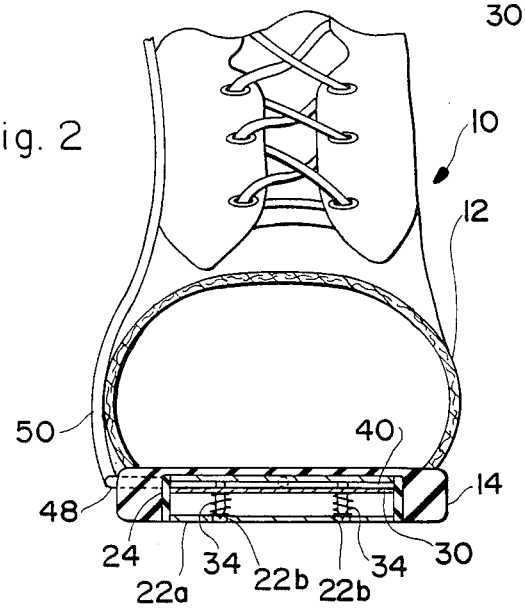
FIG. 2 is a front sectional view of a shoe sole with cleat chambers according to the present invention applied in use in footwear.
Figure 4:
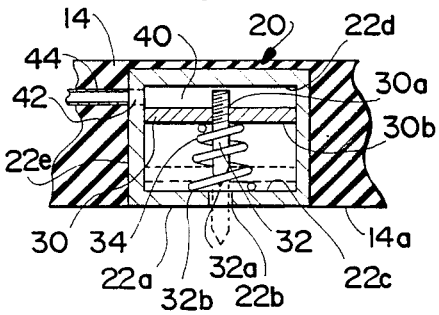
FIG. 4 is an enlarged fragmentary side sectional view of the portion enclosed within the dashed line circle in FIG. 1.

Coiled compression springs 34 are fitted between the bottom 30*b* of plate 30 and the top 22*c* of chamber bottom wall 22*a*, with the springs 34 loosely surrounding cleats 32. In this way, the springs 34 urge the plate 30 upwardly away from chamber bottom wall 22*a* to bias plate 30 to an upper retracted or raised position, as shown in FIGS. 2 and 4.

By fixing the cleats 32 in plate 30 so that the upper ends 32*b* of the cleats 32 protrude slightly above plate 30 it is possible to provide a positive stop limit to the upward excursion of the plates 30 in the chambers 20*a*, 20*b*, the abutment of the cleat upper ends 32*b* against the chamber top wall 22*d* serving as a stop. In this way, a space 40 can be maintained in the chamber 20 above the plate 30 when plate 30 is in its retracted position.

The cleats 32 are of such a length that when the plate 32 is in its retracted position, the pointed ends 32*a* of the cleats 32 do not protrude through holes 22*b*.

Where the cleats 32 are threaded into the plates 30, the threaded connection may be appropriately sealed. Similarly, the chambers 20*a*, 20*b* may be provided with sealing glands (not shown) for sealing the holes 22*b* tightly while permitting cleats 32 to be extended and retracted therethrough. Further, the plates 30 may be provided with seal members (not shown) along their peripheral edges for tightly sealing against the chamber side walls and ends, while permitting vertical movement of the plates 30 within the chambers 20*a*, 20*b*.

Figure 3:
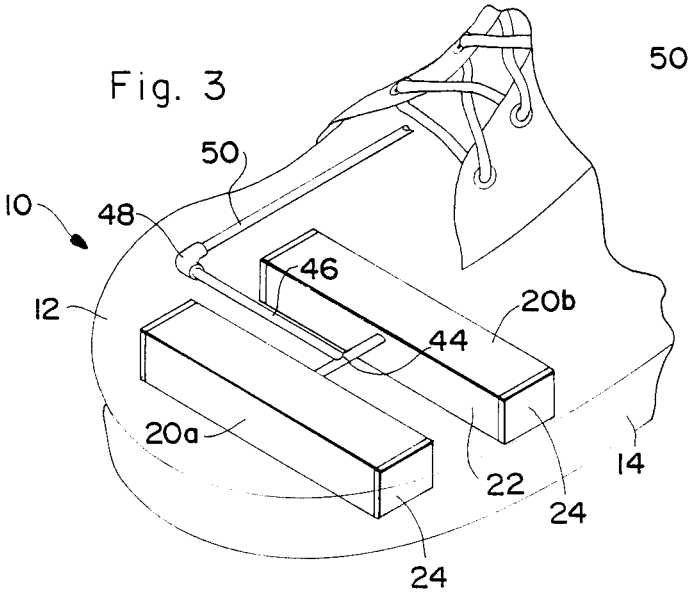
FIG. 3 is a partial perspective view showing a shoe sole with retractable cleats in accordance with the present invention as applied in use in footwear.

In each chamber 20*a*, 20*b* there is provided in a side wall 22*e* at the upper portion thereof a port 42 therethrough communicating with the space 40 of the interior volume of the chamber 20*a*, 20*b*. A pressure line 44 is suitably connected to each port 42. Pressure line 44 may typically be of plastic or rubber tubing. As shown in FIGS. 1 and 3, the pressure line 44 extends longitudinally in sole 14 for mutual communication between the ports 42 in both the chambers 20*a* and 20*b*. Mediate the ends of pressure line 44 there is connected a communicating pressure line 46 which extends transversly across sole 14 from pressure line 44. Pressure line 46 is also of rubber or plastic tubing and at its free end may protrude outwardly from the side of sole 14. Preferably, pressure lines 44 and 46 are integrally formed as a single "tee" fitting.

To the free end of pressure line 46 there is connected a 90 degree ("elbow") fitting 48 which in turn is connected to a pressure line 50. Preferably, fitting 48 is detachable from pressure line 46, and fitting 48 may also be detachable from pressure line 50.

Figure 5:
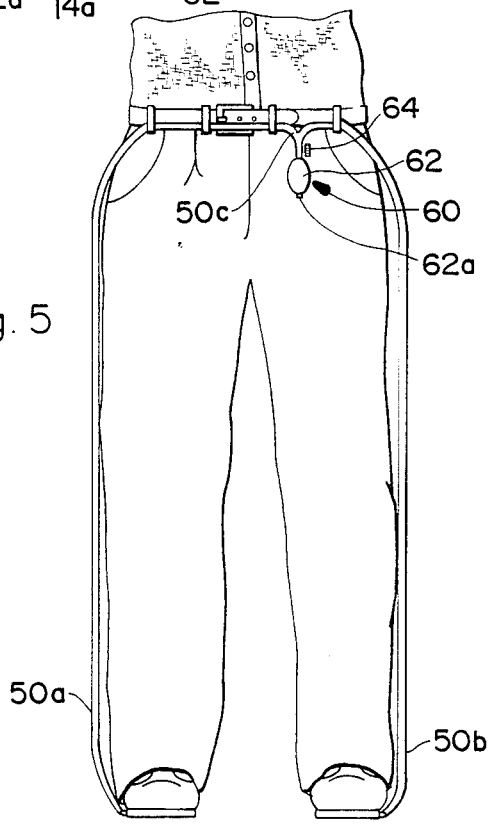
FIG. 5 is a lower frontal view showing a person wearing footwear provided with shoe soles with retractable cleats in accordance with the present invention, illustrating one possible arrangement of the pressure source and pressure lines in use.

Pressure line 50 serves to communicate the interior volumes of the chamber 20*a*, 20*b* with a pressure source which, as shown for example in FIG. 5, may take the form of a squeeze-bulb type air pump 60. Advantageously, the respective pressure lines 50*a*, 50*b* leading from respective ones of a pair of shoes equipped with soles in accordance with the invention may be commonly joined by a "wye" or "tee" fitting 50*c* which serves to mutually communicate the respective lines 50*a* and 50*b* with the pressure outlet of pump 60.

Pump 60 may be a squeeze-bulb air pump of the type commonly employed in blood pressure testing devices (sphygmomanometers) for controlling the inflating and deflating of an arm cuff. As such, the pump 60 is equipped with a squeeze bulb 62 and an adjustable bleed valve 64, whereby air admitted into squeeze bulb 62 via a one-way intake valve 62*a* may be pressurized by squeezing bulb 62 and supplied via therefrom to lines 50*a* and 50*b*, thence via lines 46 and 44 to the interior volumes of the chambers 20*a* and 20*b* in each shoe sole.

In operation, when it is desired to extend the cleats 32, it is only necessary to first close the bleed valve 64 all the way (if not already closed), e.g., by turning a handscrew or by operating a button, depending upon the particular valve type employed. With the bleed valve 64 thus closed, repeated squeezing and releasing of the bulb 62 will, in known manner, cause air under pressure to be supplied to the lines 50*a* and 50*b* communicating the pump 60 with respective ones of the pair of shoes 10 equipped with the chambers 20 in the soles thereof.

As the pressurized air is supplied via lines 46 and 44 and ports 42 to the spaces 40 above the cleat plates 30 in the interior volumes of the chambers 20, the cleat plates 30 will be forced downward in the chambers as the air pressure on the plate 30 builds and exceeds the force of the springs 34. The squeeze bulb 62 is repeatedly squeezed and released in known manner to move the cleat plates 30 downwardly in the chambers 20 until the springs 34 are sufficiently compressed and the cleats 32 are fully extended and protruding from the sole bottoms 14*a* as shown in FIG. 1, and as shown by phantom lines in FIG. 4.

In order to facilitate extending the cleats, the wearer may shift his weight back onto the heels until the cleats of the shoes are extended, or otherwise take weight off the soles 14 when extending the cleats so as not to require overcoming the wearer's weight. For example, extension of the cleats may be facilitated if the wearer is sitting or otherwise supported with his weight off of the shoe soles.

Once the cleats 32 of both shoes have been fully extended, and it is no longer possible to further squeeze the bulb 62 without difficulty, the extending operation is done, and air pressure in the chambers 20 will keep the cleat plates 30 depressed until the bleed valve 64 is opened to release the pressurized air. Because of the inherent compressibility of air, the chamber 20 and cleat pins 32 should be adequately sized to accommodate some upward retreating of the cleat plate 30 into the chamber 20 under the weight of the wearer while still providing sufficient protrusion of the cleats 32 from the sole to ensure traction gripping on ice without slipping.

Thus, the cleats of both shoes can be extended simultaneously by the manual remote operation of the pump 60 using one hand. Similarly, when it is desired to retract the cleats it is only necessary to open bleed valve 64 to release the air pressure in the chambers 20 and lines 44, 46 and 50 sufficiently to allow the springs 34 to urge the cleat plates 30 upwardly until the cleats 32 are withdrawn fully within soles 14. Thus retraction of the cleats of both shoes can also be performed with one hand by remote control. And because the pump 60 can be worn on the wearer's person at any convenient location remote from the feet, such as at the waist, no stooping or bending is required when extending or retracting the cleats with the shoe sole of the present invention. Thus, for example, by further lengthening the line 50*c* the pump 60 could be located at the end of one sleeve of the wearer's coat so as to be easily grasped and operated.

Figure 6:
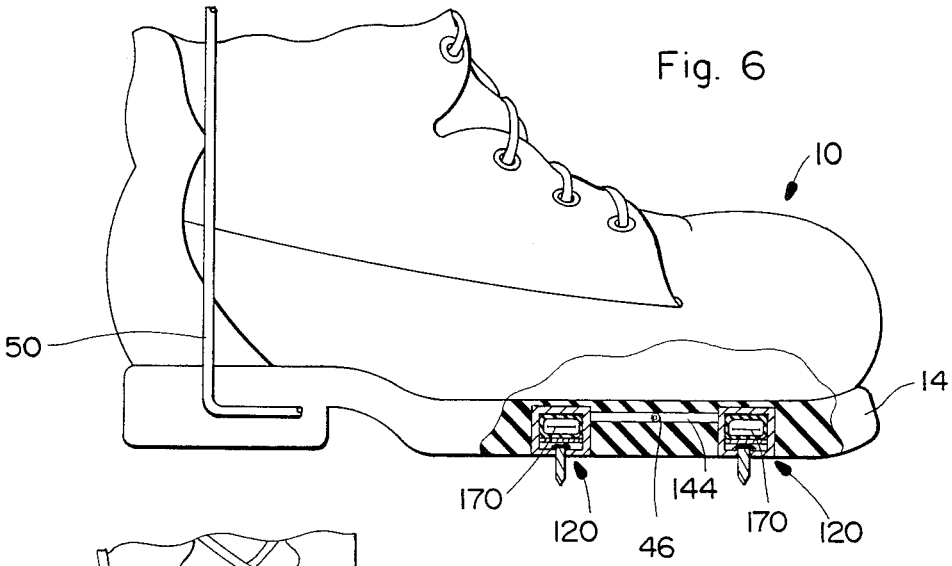
FIGS. 6, 7 and 8 show side, front and enlarged partial side sectional views, respectively, of an alternative embodiment employing inflatable/collapsible members in the chambers.
Figure 7:
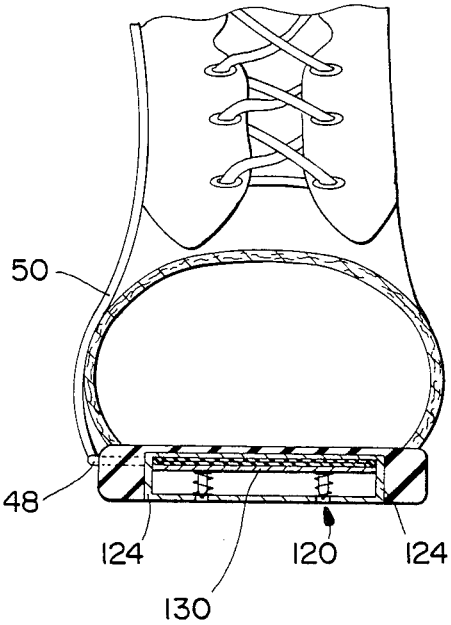
Figure 8:
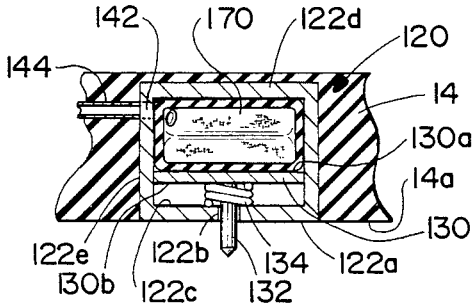

An alternative embodiment of the chamber and cleat plate arrangement of the present invention is illustrated in FIGS. 6, 7 and 8, which figures otherwise correspond with FIGS. 1, 2 and 4 respectively. In this embodiment, the rectangular chambers 120 are similar in structure to the chambers 20 of the previous embodiment, and include a bottom wall 122*a* having an inner surface 122*c* and provided centrally therethrough with spaced holes 122*b*, along with a top wall 122*d*, and side walls 122*e*. Chambers 120 may be closed at each end by end caps 124. It is contemplated that the chambers 120, as well as the chambers 20 of the previous embodiment, could be formed directly in the sole 14, as integral parts thereof, as by molding, laminating or other known fabrication methods.

A flat rectangular cleat plate 130 is fitted in each chamber 120 for vertical movement therewithin. From the bottom of each of the cleat plates 130 extend a pair of cleats 132 which are fastened securely to the plate 130. Springs 134 are fitted between the bottom 130*b* of the plate 130 and the chamber bottom wall 122*c* with a spring 134 loosely surrounding each cleat 132.

The cleats 132 do not extend through the plates 130. Rather, the top surfaces 130*a* of the cleat plates 130 are smooth and unbroken.

In the space above each cleat plate 130 there is provided an inflatable member 170 which is in communication with an air supply line 144 via a port 142 in the chamber side wall 122*e*. The inflatable member 170 may be a collapsible airtight elastic air sac or the like such as a balloon of rubber, or it may take the form of a flexible bellows or air bladder.

In this embodiment, air under pressure is supplied from the pump 60 via the lines 50 and 46 to the supply line 144 and thence to each inflatable member 170 to cause inflation of the inflatable members 170. That is, the inflatable members are normally in a collapsed state, as shown in FIG. 7, when air under pressure is not supplied thereto, due to the urging force of the springs 134 which push the plate 130 upwardly. However, when air under pressure is supplied to each inflatable member 170 it will begin to inflate and in turn force the cleat plate 130 downwardly against the force of the springs 134. When the inflatable member 170 is sufficiently inflated, the cleat plate 130 will be pushed downwardly, compressing the springs 134 and extending the cleats 132, in like manner as in the previous embodiment. Similary, releasing the air pressure by opening the bleed valve 64 will cause the inflatable member 170 to deflate and collapse under the force of the springs 134 on the cleat plate 130, thus retracting the cleats 132 in like fashion as in the previous embodiment.

The use of the inflatable members 170 has the advantage that sealing between the cleat plate 130 and chamber 120 is not a critical concern in this embodiment. Furthermore, it is not otherwise necessary to provide any clearance space above the cleat plates 130 since the collapsed thickness of the inflatable member itself performs this function.

From the above detailed description it will be readily apparent that various modifications and variations can be made to the shoe sole with retractable cleats of the present invention without departing from the scope of the invention which is intended to be limited only by the appended claims. For example, it would be quite simple to substitute other sources of pneumatic pressure for the squeeze bulb, or a hydraulic, rather than pneumatic, pressure source could be used. Similarly, more or less than a pair of cleats can be provided on each cleat plate, and more or less than a pair of chambers can be provided in each sole. Still further, the chambers and cleat plates could be square or circular rather than rectangular. Or an additional chamber could be provided in the heel portion of the sole. It will be readily appreciated therefore that, given the teaching of the present disclosure many variations within the scope of the present invention will occur to those of ordinary skill in the art.

I claim:

1. A shoe sole, comprising:

a sole portion for supporting the wearer's foot;

at least one chamber provided in said sole portion, said chamber having top, side and bottom walls enclosing an interior volume of said chamber, at least one opening being provided in said bottom wall;

a cleat plate provided horizontally in each said chamber and vertically movable therein, said cleat plate having at least one cleat extending from a bottom thereof in a position corresponding with said opening in said chamber bottom wall, said cleat being able to pass through said opening;

means for urging said cleat plate upwardly away from said chamber bottom wall;

a fluid communication port in each said chamber whereby fluid pressure may be communicated to said chamber; and an inflatable member provided in each said chamber between said cleat plate and said chamber top wall, said inflatable member being in fluid communication with said fluid communication port of said chamber.

2. A shoe sole according to claim 1 further comprising a fluid pressure source means in fluid communication with said fluid communication port of each said chamber for supplying fluid pressure to said fluid communication port.

3. A shoe sole, comprising:

a sole portion for supporting the wearer's foot;

at least one chamber provided in said sole portion, said chamber having top, side and bottom walls enclosing an interior volume of said chamber, at least one opening being provided in said bottom wall;

a cleat plate provided horizontally in each said chamber and vertically movable therein, said cleat plate having at least one cleat extending from a bottom thereof in a position corresponding with said opening in said chamber bottom wall, said cleat being able to pass through said opening;

means for urging said cleat plate upwardly away from said chamber bottom wall;

an inflatable member provided in each said chamber between said cleat plate and said chamber top wall; and a source of fluid pressure in selective communication with each said inflatable member, for selectively pressurizing said inflatable member for inflating same to force said cleat plate downwardly against the urging of said urging means to extend said at least one cleat thereof through said opening in said chamber bottom wall.

4. A shoe sole according to claim 3 wherein said source of fluid pressure comprises an air pump.

5. A shoe sole according to claim 3 further comprising fluid pressure supply line means for fluid communication between said inflatable member and said source of fluid pressure.

6. A shoe sole according to claim 3 wherein said source of fluid pressure is a squeeze bulb air pump having a bleed valve.

7. A shoe sole according to claim 3 wherein a bottom surface of each said chamber is made flush with a bottom tread surface of said sole portion.

8. A shoe sole according to claim 3 wherein an opening is provided in a bottom tread surface of said sole portion in correspondence with each said opening in said chamber bottom wall, for passing each said cleat therethrough.

9. A shoe sole, comprising:

a sole portion for supporting the wearer's foot;

at least one chamber provided in said sole portion, said chamber having top, side and bottom walls enclosing an interior volume of said chamber, at least one opening being provided in said bottom wall;

a cleat plate provided horizontally in each said chamber and vertically movable therein, said cleat plate having at least one cleat extending from a bottom thereof in a position corresponding with said opening in said chamber bottom wall, said at least one cleat being able to pass through said opening, said at least one cleat being threadedly held in said cleat plate whereby the position of said cleat relative said cleat plate is adjustable, an upper end of said at least one cleat protruding above said cleat plate for abutting said chamber top wall to provide a positive stop limit to upward vertical excursion of said cleat plate in said chamber;

means for urging said cleat plate upwardly away from said chamber bottom wall; and a source of fluid pressure in selective fluid communication with a portion of said chamber interior volume above said cleat plate, for selectively pressurizing said space above said cleat plate to force said cleat plate downwardly against the urging of said urging means to extend said at least one cleat plate thereof through said opening in said chamber bottom wall.

* * * * *